US012696947B2

(12) United States Patent
Ishikawa

(10) Patent No.: US 12,696,947 B2
(45) Date of Patent: Aug. 4, 2026

(54) HELMET AND CHEEK PAD

(71) Applicant: SHOEI CO., LTD., Tokyo (JP)

(72) Inventor: Kyosuke Ishikawa, Tokyo (JP)

(73) Assignee: SHOEI CO., LTD., Tokyo (JP)

( * ) Notice: Subject to any disclaimer, the term of this patent is extended or adjusted under 35 U.S.C. 154(b) by 436 days.

(21) Appl. No.: 18/248,636

(22) PCT Filed: Jun. 8, 2021

(86) PCT No.: PCT/JP2021/021666
§ 371 (c)(1),
(2) Date: Apr. 11, 2023

(87) PCT Pub. No.: WO2022/085234
PCT Pub. Date: Apr. 28, 2022

(65) Prior Publication Data

US 2023/0404198 A1 Dec. 21, 2023

(30) Foreign Application Priority Data

Oct. 19, 2020 (JP) ..... 2020-175124

(51) Int. Cl.
*A42B 3/04* (2006.01)
*A42B 3/06* (2006.01)
*A42B 3/12* (2006.01)

(52) U.S. Cl.
CPC ..... *A42B 3/06* (2013.01); *A42B 3/0493* (2013.01); *A42B 3/12* (2013.01)

(58) Field of Classification Search
CPC ..... A42B 3/127; A42B 3/0493; A42B 3/12; A42B 3/125; A42B 3/18; A42B 3/326
(Continued)

(56) References Cited

U.S. PATENT DOCUMENTS 4,598,430 A * 7/1986 Nava ..... A42B 3/326 2/424
5,088,129 A 2/1992 Kamata
(Continued)

FOREIGN PATENT DOCUMENTS

EP 0976336 B1 5/2003
GB 2048056 A 12/1980
(Continued)

OTHER PUBLICATIONS

European Search Report for European Patent Application No. 21882377.1 dated Oct. 21, 2024.
(Continued)

*Primary Examiner* — Jameson D Collier
(74) *Attorney, Agent, or Firm* — CANTOR COLBURN LLP

(57) ABSTRACT

A helmet includes a helmet body and right and left cheek pads arranged inside the helmet body. The cheek pads each include a first bottom portion including a first outer surface located downward from a lower edge of the helmet body and a second bottom portion including a second outer surface located rearward from the first bottom portion. The first outer surface and the second outer surface form a wearing opening of the helmet and are negative pressure generating surfaces configured to generate a downforce acting on the helmet by having the first outer surface located downward from the second outer surface. The first bottom portion and the second bottom portion are resilient so as to enlarge the wearing opening when receiving force for enlarging the wearing opening and reduce the wearing opening in size when the force is removed.

5 Claims, 5 Drawing Sheets

(58) Field of Classification Search
USPC ..... 2/411, 414, 424
See application file for complete search history.

(56) References Cited

U.S. PATENT DOCUMENTS

| | | | | |
|---|---|---|---|---|
| 5,090,061 | A * | 2/1992 | Kamata | A42B 3/16 2/423 |
| 5,575,018 | A | 11/1996 | Rothrock | |
| 6,138,284 | A | 10/2000 | Arai | |
| 6,185,753 | B1 | 2/2001 | Arai | |
| 8,490,214 | B2 * | 7/2013 | Crye | F41H 1/00 2/2.5 |
| 2011/0145964 | A1 * | 6/2011 | Crye | F41H 1/04 2/2.5 |
| 2014/0259311 | A1 | 9/2014 | Murakami | |
| 2020/0138142 | A1 * | 5/2020 | Kim | A42B 3/328 |

FOREIGN PATENT DOCUMENTS

| | | | |
|---|---|---|---|
| JP | H0444324 | U | 4/1992 |
| JP | 2000017514 | A | 1/2000 |
| JP | 2002138319 | A | 5/2002 |
| WO | 2013065176 | A1 | 5/2013 |

OTHER PUBLICATIONS

International Search Report for International Application No. PCT/JP2021/02166, International Filing Date Jun. 7, 2021, Date of Mailing Aug. 3, 2021, 2 pages.
Notice of Reasons for Refusal in Japanese Patent Application No. 2020-175124, Filing Date Oct. 19, 2020, Date of Mailing Jan. 4, 2023, 6 pages.

* cited by examiner

HELMET AND CHEEK PAD

TECHNICAL FIELD

The present disclosure relates to a helmet and a cheek pad attached to the helmet.

BACKGROUND ART

It is known that a helmet includes interior pads inside a helmet body to improve wearing comfort for a wearer. The interior pads include a front pad abutting the forehead of the wearer, a rear pad abutting the back of the head of the wearer, side pads abutting the sides of the head of the wearer, a top pad abutting the top of the head of the wearer, and cheek pads abutting the cheeks of the wearer. The interior pads are deformed in conformance with the shape of the head of the wearer to increase contact with the wearer. This improves the support and fit of the helmet (refer to Patent Document 1).

CITATION LIST

Patent Literature

Patent Literature 1: International Patent Publication WO2013/065176

SUMMARY OF INVENTION

Technical Problem

An airflow produced by a helmet when a motorcycle or the like is traveling generates lift, which is a lift force that lifts the helmet. When a helmet is subject to such lift, the lift will be transmitted to the head of a wearer to distract the wearer or lower steering stability. Thus, it is desirable that lift acting on the helmet be reduced when a motorcycle or the like is traveling.

Solution to Problem

A helmet according to one aspect of the present disclosure includes a helmet body and right and left cheek pads arranged inside the helmet body. The cheek pads each include a first bottom portion including a first outer surface located downward from a lower edge of the helmet body and a second bottom portion including a second outer surface located rearward from the first bottom portion. The first outer surface and the second outer surface form a wearing opening of the helmet and are negative pressure generating surfaces configured to generate a downforce acting on the helmet by having the first outer surface located downward from the second outer surface. The first bottom portion and the second bottom portion are resilient so as to enlarge the wearing opening when receiving force for enlarging the wearing opening and reduce the wearing opening in size when the force is removed.

A cheek pad according to another aspect of the present disclosure is arranged inside a helmet body of a helmet. The cheek pad includes a first bottom portion including a first outer surface located downward from a lower edge of the helmet body when arranged in the helmet body and a second bottom portion including a second outer surface located rearward from the first bottom portion when arranged in the helmet body. The first outer surface and the second outer surface form a wearing opening of the helmet and are negative pressure generating surfaces configured to generate a downforce acting on the helmet by having the first outer surface located downward from the second outer surface. The first bottom portion and the second bottom portion are resilient so as to enlarge the wearing opening when receiving force for enlarging the wearing opening and reduce the wearing opening in size when the force is removed.

DESCRIPTION OF EMBODIMENTS

A helmet and cheek pads according to one embodiment will now be described with reference to the drawings. In FIGS. 1 to 8, the forward, rearward, leftward, rightward, upward, and downward directions as viewed from a wearer of a helmet correspond to the forward, rearward, leftward, rightward, upward, and downward directions of the helmet. Further, the forward, rearward, leftward, rightward, upward, and downward directions as viewed from the wearer of the helmet correspond to the forward, rearward, leftward, rightward, upward, and downward directions of the cheek pads.

Figure 1:
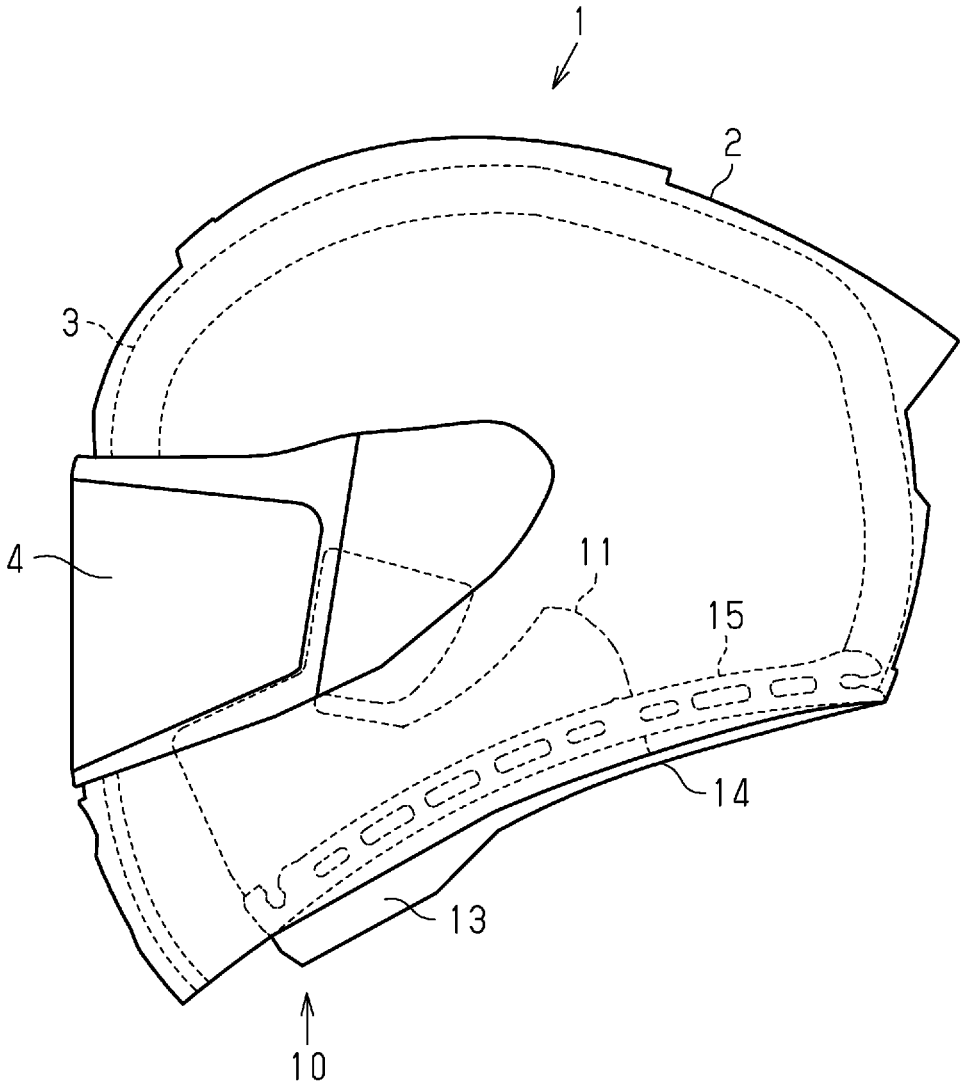
FIG. 1 is a side view of a helmet according to one embodiment.

As shown in FIG. 1, a helmet 1 is a full-face helmet. The helmet 1 includes a helmet body 2 and cheek pads 10.

The helmet body 2 forms the shell of the helmet. The helmet body 2 is a hemispherical plastic member. The helmet body 2 is made of a material selected from, for example, acrylonitrile-butadiene-styrene copolymers (ABS), polycarbonate (PC), thermosetting resin impregnated with reinforcing fibers, and the like.

The helmet body 2 may accommodate a liner 3, which is an interior member that absorbs impact. The liner 3 is shaped in conformance with the inner surface of the helmet body 2. The liner 3 is made of, for example, resin foam such as styrene foam.

The helmet body 2 may accommodate a shield 4, which is a transparent plate member that is light-transmissive, a mechanism that supports the shield 4, and a mechanism for operating the shield 4. The shield 4 prevents foreign material and rain which fly from the front, and wind from entering the helmet 1. This improves the visibility of the wearer.

The cheek pads 10 are right and left interior pads attached to the inner side of the helmet body 2. The right and left cheek pads 10 are shaped to be plane-symmetrical relative to an imaginary plane (not shown) that is located in the middle of the helmet 1 in the right-left direction. When the helmet 1 is worn, the cheek pads 10 abut the cheeks of the wearer to increase the contact between the helmet 1 and the wearer and improve wearing comfort. The cheek pads 10 are each formed by, for example, a cushion made of urethane foam or the like and a cover body that covers the cushion. The cover body is bag-shaped and formed by sewing together, for example, a fabric that abuts the cheek of the wearer, a flexible plastic plate fixed to the helmet body 2, and synthetic leather projecting downward from the helmet body 2.

In addition to the cheek pads 10, the helmet 1 may include various types of interior pads that are less rigid than the liner 3 and arranged inside the helmet body 2 such as a front pad abutting the forehead, a rear pad 5 (refer to FIG. 4) abutting the back of the head, side pads abutting the sides of the head, and a top pad abutting the top of the head. The interior pads improve cushioning for the head. The helmet 1 may also include a chin strap (not shown) that fixes, for example, the chin of the wearer to the helmet.

The cheek pads 10 will now be described with reference to FIGS. 2 and 3. Only one of the right and left cheek pads 10, which are plane-symmetrical, is illustrated in the drawings for the sake of convenience.

Figure 2:
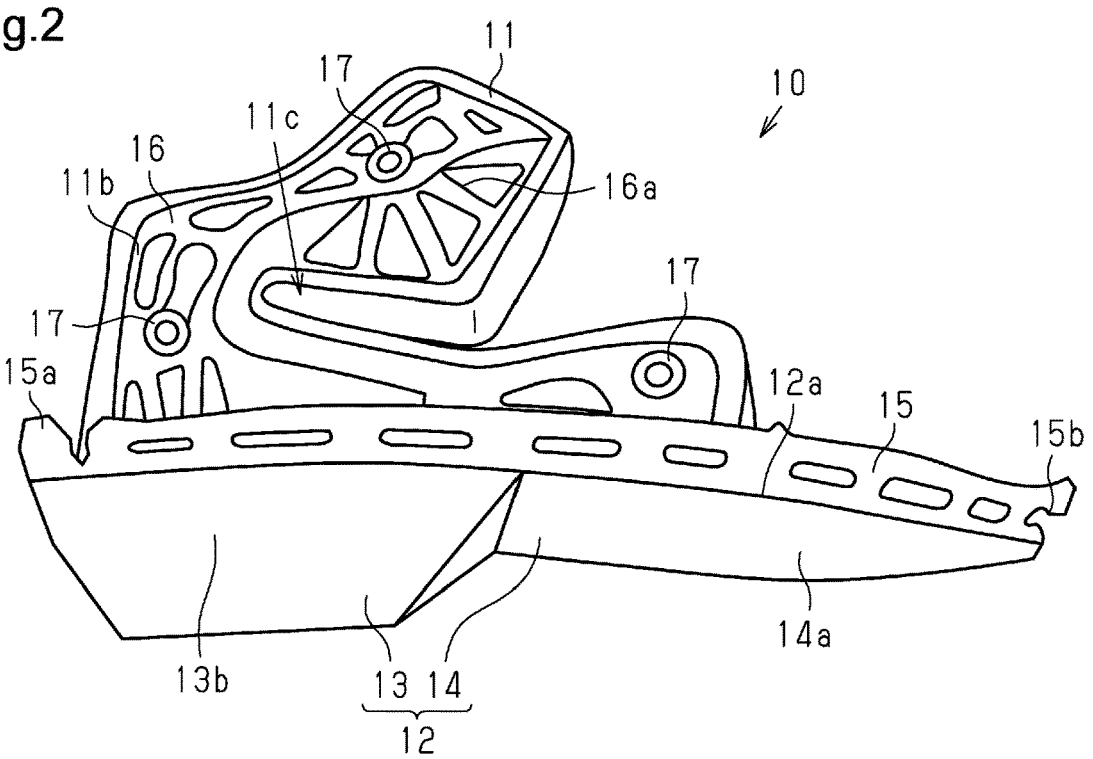
FIG. 2 is a lower perspective view showing a cheek pad of the helmet illustrated in FIG. 1.
Figure 3:
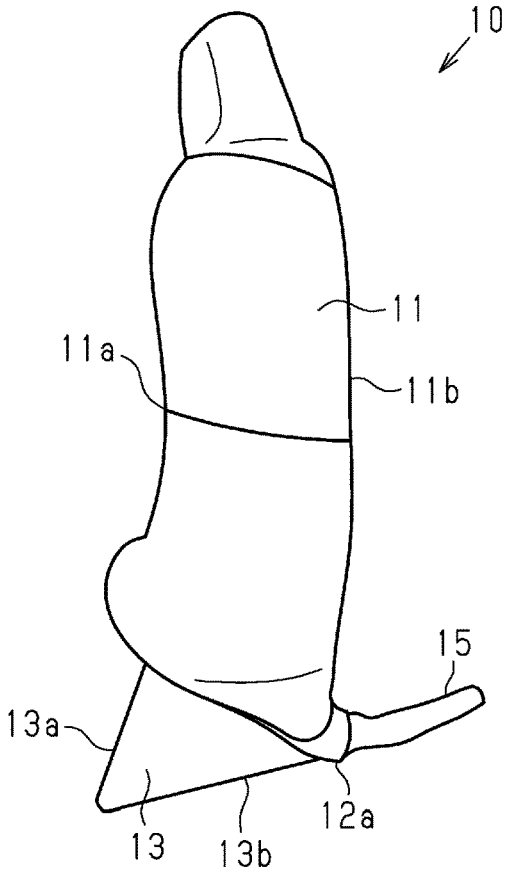
FIG. 3 is a front view showing the cheek pad of the helmet illustrated in FIG. 1.

As shown in FIGS. 2 and 3, the cheek pad 10 includes a body portion 11 that is the upper portion of the cheek pad 10 and a bottom portion 12 that is the lower portion of the cheek pad 10. The bottom surface of the body portion 11 is connected to the bottom portion 12.

The body portion 11 includes a contact surface 11*a*, made of fabric that contacts the cheek of the wearer, and a fixed surface 11*b*, formed by a flexible plastic plate facing the liner 3. The fixed surface 11*b* is shaped in conformance with the inner surface of the liner 3. When the cheek pad 10 is attached to the helmet body 2, the body portion 11 is located inside the helmet body 2 facing the inner surface of the liner 3. The body portion 11 may include a slit-shaped gap 11*c* through which the chin strap is inserted.

The fixed surface 11*b* is the surface of a plate 16 used to sustain the shape of a cushion of the body portion 11. The surface of the plate 16 defines the surface of the body portion 11. The plate 16 is formed by a flexible plastic plate that forms the cover body. The plate 16 may be hollowed out by holes 16*a* for purposes such as reduction in weight and elasticity.

Three female buttons 17 are attached to the fixed surface 11*b*. The female buttons 17, attached to the fixed surface 11*b*, project outward from the holes 16*a* of the plate 16. The female buttons 17 are engaged with male buttons of the liner 3 to fix the cheek pad 10 to the inner side of the liner 3. The quantity of the female buttons 17 and the male buttons of the liner 3 is not limited and may be four or more or two or less.

The bottom portion 12 extends from the front lower end to the rear lower end of the body portion 11. The rear end of the bottom portion 12 extends further rearward from the rear end of the body portion 11. Further, a side edge 12*a*, which is one of the two edges in the right-left direction at the upper end of the bottom portion 12, is shaped to be arcuate in conformance with the lower edge of the helmet body 2.

The bottom portion 12 includes a first bottom portion 13 that is located at the front of the bottom portion 12 and a second bottom portion 14 that is located at the rear of the bottom portion 12. The first bottom portion 13 includes an inner surface 13*a* and a first outer surface 13*b*. The second bottom portion 14 includes a second outer surface 14*a*. The inner surface 13*a*, the first outer surface 13*b*, and the second outer surface 14*a* are, for example, made of synthetic leather that forms the cover body.

The inner surface 13*a* extends downward from the lower end of the contact surface 11*a*. The inner surface 13*a* is arranged to face the neck of the wearer when the helmet 1 is worn. The inner surface 13*a* may be a curved surface of arcuate curves continuous in the up-down direction and extending in the front-rear direction in conformance with the cheek of the wearer or may be a flat surface of straight lines continuous in the up-down direction and extending in the front-rear direction.

The first outer surface 13*b* extends downward from the side edge 12*a* and is a sloped surface extending toward the lower end of the inner surface 13*a*. The first outer surface 13*b* is located downward from the lower edge of the helmet body 2 when the helmet 1 is worn. Further, the first outer surface 13*b* is located downward from the second outer surface 14*a*. The first outer surface 13*b* may be a curved surface of arcuate curves continuous toward the lower inner side and extending in the front-rear direction in conformance with the side edge 12*a* of the bottom portion 12 or may be a flat surface of straight lines continuous toward the lower inner side extending in the front-rear direction.

The first bottom portion 13 may be triangular and downwardly narrowed, rectangular, or trapezoidal and downwardly narrowed when viewed from the front. The first bottom portion 13 may have the form of a triangular post including the inner surface 13*a* and the first outer surface 13*b* and extending in the front-rear direction. Alternatively, the first bottom portion 13 may have the form of a quadrangular post extending in the front-rear direction. The first bottom portion 13 may be toothed and downwardly narrowed. The front surface of the first bottom portion 13 may be a sloped surface inclined downwardly toward the rear or a vertical surface extending in the up-down direction. The rear surface of the first bottom portion 13 may be a sloped surface inclined downwardly toward the front or a vertical surface extending in the up-down direction.

The second bottom portion 14 is the part of the bottom portion 12 of the cheek pad 10 that is located rearward from the first bottom portion 13. The second outer surface 14*a* of the second bottom portion 14 extends from the rear end of the first bottom portion 13 to the rear end of the bottom portion 12. The second outer surface 14*a* may be located at substantially the same height as the lower edge of the helmet body 2, downward from the lower edge of the helmet body 2, or upward from the lower edge of the helmet body 2 when the helmet is worn.

The relationship of a lift 25 (refer to FIG. 6), which is the lift force acting on the helmet 1, and the locations of the first outer surface 13*b* and the second outer surface 14*a* will now be described. When a motorcycle or the like is traveling, the airflow produced around the helmet causes a lift 25, which is a force that lifts the helmet 1 from the head of the wearer, to act on the helmet 1. The first outer surface 13*b* is located downward from the lower edge of the helmet body 2. Thus, the first outer surface 13*b* guides the airflow passing the side of the helmet 1, when the motorcycle or the like is traveling, downward from the helmet 1. The airflow guided downward from the side of the helmet 1 by the first outer surface 13*b* generates a downforce 26 (refer to FIG. 6) that acts on the first outer surface 13*b*. The downforce 26 is a force acting in a direction canceling the lift 25 and pulls the helmet 1 downward. The first outer surface 13*b* is located downward from the second outer surface 14*a*. Thus, the airflow guided downward from the helmet 1 by the first outer surface 13*b* generates the downforce 26 that also acts on the second outer surface 14*a*. As a result, the lift 25 acting on the helmet 1 is reduced by the downforce 26 that acts on the first outer surface 13*b* and the second outer surface 14*a*.

A fixing piece 15 is attached to the side edge 12*a*. The fixing piece 15 is a flexible plastic member. The fixing piece 15 includes a first engagement portion 15*a* located at the front end of the fixing piece 15 and a second engagement portion 15*b* located at the rear end of the fixing piece 15. The fixing piece 15 is inserted between the helmet body 2 and the liner 3, and the first engagement portion 15*a* and the second engagement portion 15*b* are engaged with engaging portions (not shown), which are arranged in the helmet body 2 and the liner 3, to fix the cheek pad 10 to the helmet body 2.

The side edge 12*a* of the bottom portion 12 is fixed to the helmet body 2 and the liner 3 by the fixing piece 15. The upper surface of the bottom portion 12 is fixed to the liner 3 by the female buttons 17 of the body portion 11. The bottom portion 12 is positioned relative to the helmet body 2 so that the lower end of the first outer surface 13*b* projects downward from the second outer surface 14*a* when the helmet 1 is worn by the wearer. The flexibility of the cushion forming the cheek pad 10 allows the cheek pad 10 to be bent in order to enlarge a wearing opening 6 (refer to FIG. 4) of the helmet 1 using the side edge 12*a* of the bottom portion 12 and the upper surface of the bottom portion 12 as fixed ends.

Figure 4:
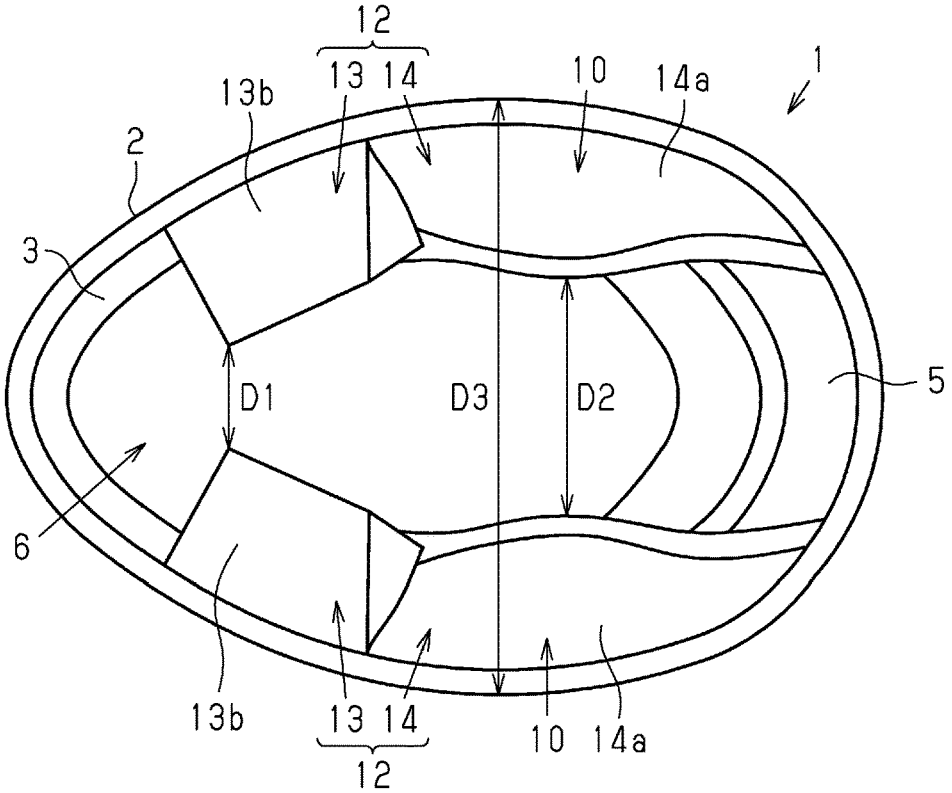
FIG. 4 is a bottom view of the helmet illustrated in FIG. 1.

As shown in FIG. 4, the helmet 1 includes the wearing opening 6 used by the wearer to wear the helmet 1. The wearing opening 6 is part of an opening of the helmet body 2 for insertion of the head of the wearer. The wearing opening 6 is defined by the edges of the liner 3, the rear pad 5, the first bottom portion 13, and the second bottom portion 14.

In the wearing opening 6, the width D1 between the lower ends of the first outer surfaces 13*b* of the right and left cheek pads 10 may be greater than or less than the width D2 between the lower ends of the second outer surfaces 14*a* of the right and left cheek pads 10. In other words, the lower ends of the first outer surfaces 13*b* may be located closer to or farther from the middle of the wearing opening 6 than the lower ends of the second outer surfaces 14*a*. The width D1 may be the smallest width of the wearing opening 6 in the right-left direction. The rear ends of the first bottom portions 13 may be located frontward or rearward from where the width of the helmet body 2 in the right-left direction is the maximum, or the right-left maximum width D3.

The relationship of a drag 27 (refer to FIG. 6), which is the drag force acting on the helmet 1, and the location of the first outer surface 13*b* will now be described. When the motorcycle or the like is traveling, the airflow produced around the helmet 1 causes the drag 27 to act on the helmet 1. The drag 27 is a force acting in a direction opposite to the traveling direction and pulls the helmet 1 rearward. In one example of the present embodiment, the rear end of the first outer surface 13*b* is located frontward from where the helmet body 2 has the right-left maximum width D3. Even when the rear end of the first outer surface 13*b* is located rearward from where the helmet body 2 has the right-left maximum width D3, the downforce 26 will reduce the lift 25 as described above. However, the first outer surface 13*b* is a sloped surface. Thus, elongation of the first outer surface 13*b* along the side surface of the helmet body 2 will increase the drag 27. It is thus preferable that the rear end of the first outer surface 13*b* be located frontward from where the helmet body 2 has the right-left maximum width D3 in order to limit the drag 27.

The shape of the helmet body 2 may be designed based on statistics of the human body structure so that the right-left maximum width D3 among the widths in the helmet body 2 in the right-left direction substantially corresponds to where the middle of the neck of the wearer is located in the front-rear direction. In this case, the first bottom portion 13 of the cheek pad 10 may be located frontward or rearward from the location of the right-left maximum width D3, or the neck of the wearer.

To wear the helmet 1, the wearer pushes the first bottom portions 13 and the second bottom portions 14 outward from the wearing opening 6 to enlarge the wearing opening 6 and then fits the head into the wearing opening 6. When the force that enlarges the wearing opening 6 is removed, the resilience of the cushions of the first bottom portions 13 and the second bottom portions 14 returns the enlarged wearing opening 6 to its original size. In other words, the resiliency of the first bottom portions 13 and the second bottom portions 14 enlarges the wearing opening 6 and reduces the wearing opening 6 in size when the force enlarging the wearing opening 6 is removed.

Figure 5:
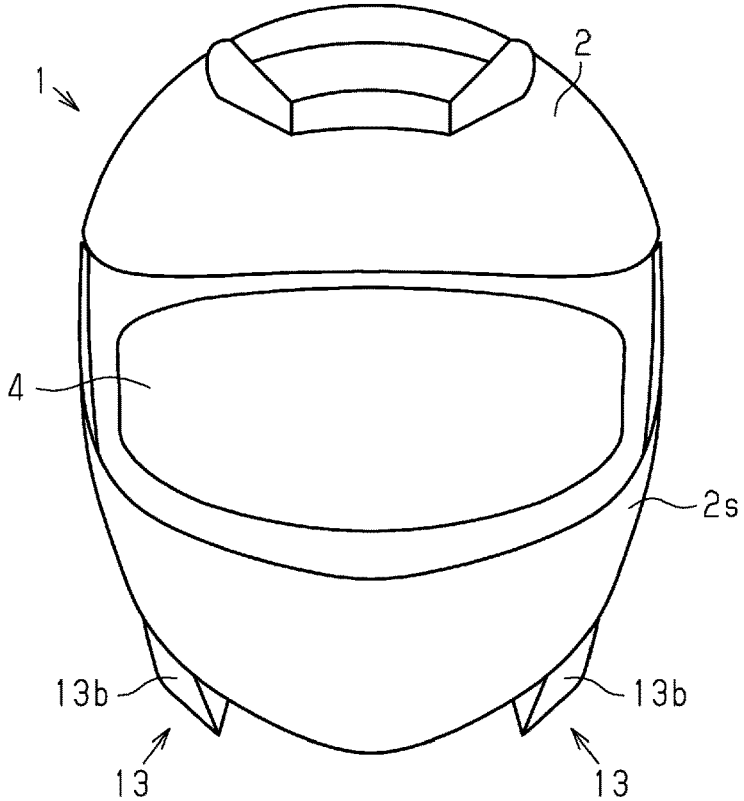
FIG. 5 is a front view of the helmet illustrated in FIG. 1.

As shown in FIG. 5, the first outer surfaces 13*b* project downward from the lower edge of the helmet body 2 and toward the middle of the wearing opening 6 and narrows the wearing opening 6 in the right-left direction. In other words, the first outer surfaces 13*b* project from the lower edge of the helmet body 2 and the first outer surfaces 13*b* are resilient so that steps formed between the neck of the wearer and the helmet body 2 in the right-left direction are smoothly filled by the first bottom portions 13 when viewed from the front of the helmet 1. In this case, the first outer surfaces 13*b* may have a gradient or curvature so as to be smoothly continuous with the curve of an external surface 2*s* of the helmet body 2.

The operations of the helmet 1 and the cheek pad 10 according to the present disclosure will now be described with reference to FIGS. 6 and 7.

Figure 6:
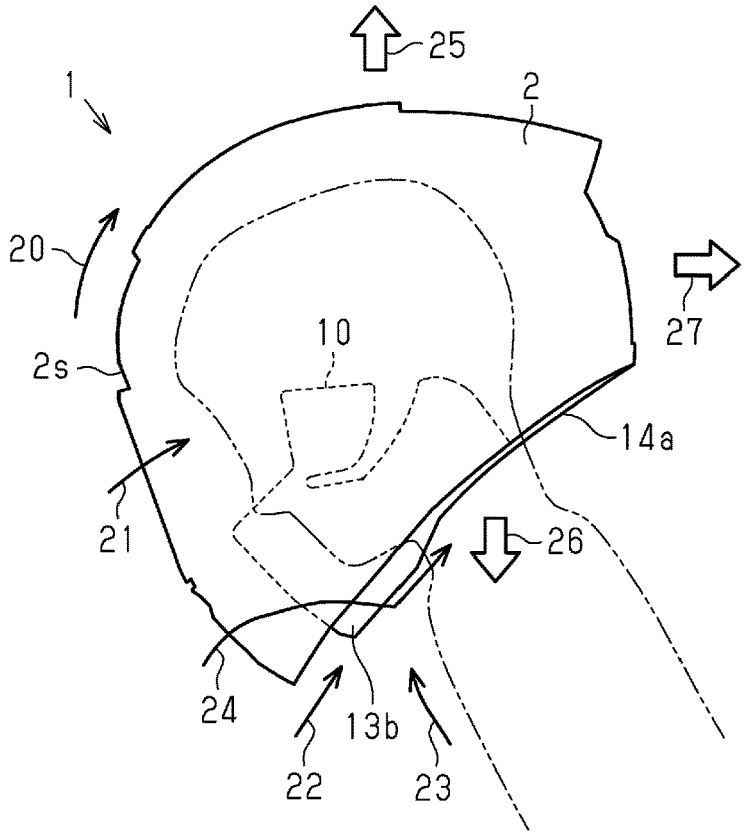
FIG. 6 is a schematic side view of the helmet illustrated in FIG. 1 and shows the flow of air when a motorcycle or the like is traveling.

As shown in FIG. 6, when the wearer wears the helmet 1, the first bottom portion 13 and the second bottom portion 14 are located between the lower edge of the helmet body 2 and the shoulder of the wearer. The wearer of the helmet 1 leans forward when riding a motorcycle or the like.

When the motorcycle or the like is traveling, air flows from the front of the helmet 1 toward the rear along the external surface 2*s* of the helmet body 2. This produces airflows around the helmet 1. Specifically, the airflows produced around the helmet 1 include an airflow 20 that passes above the helmet 1, an airflow 21 that passes the side of the helmet 1, and an airflow 22 directed downward and passing between the helmet 1 and the shoulder of the wearer of the helmet 1. The airflow 22 includes an airflow 23 that strikes the chest of the wearer and goes around the shoulder of the wearer. The airflow 21 includes an airflow 24 that passes near the lower edge of the external surface 2*s* and is guided downward from the helmet body 2 along the first outer surface 13*b* and merged with the airflow 22 without being separated from the helmet 1.

The first bottom portion 13, which smoothly fills the step formed between the neck of the wearer and the helmet body 2, is preferable to avoid the separation of the airflow 24 from helmet 1. The first outer surface 13*b*, which is smoothly continuous with the external surface 2*s* of the helmet body 2, is also preferable to avoid the separation of the airflow 24 from the helmet 1.

The lift 25, which is the force that lifts the helmet 1 from the head of the wearer, acts on the helmet 1 due to the airflow 20 or the like produced when traveling. The downforce 26, which is the force acting on the helmet 1 in the direction canceling the lift 25, is produced by the airflows 22, 24 when traveling.

Figure 7:
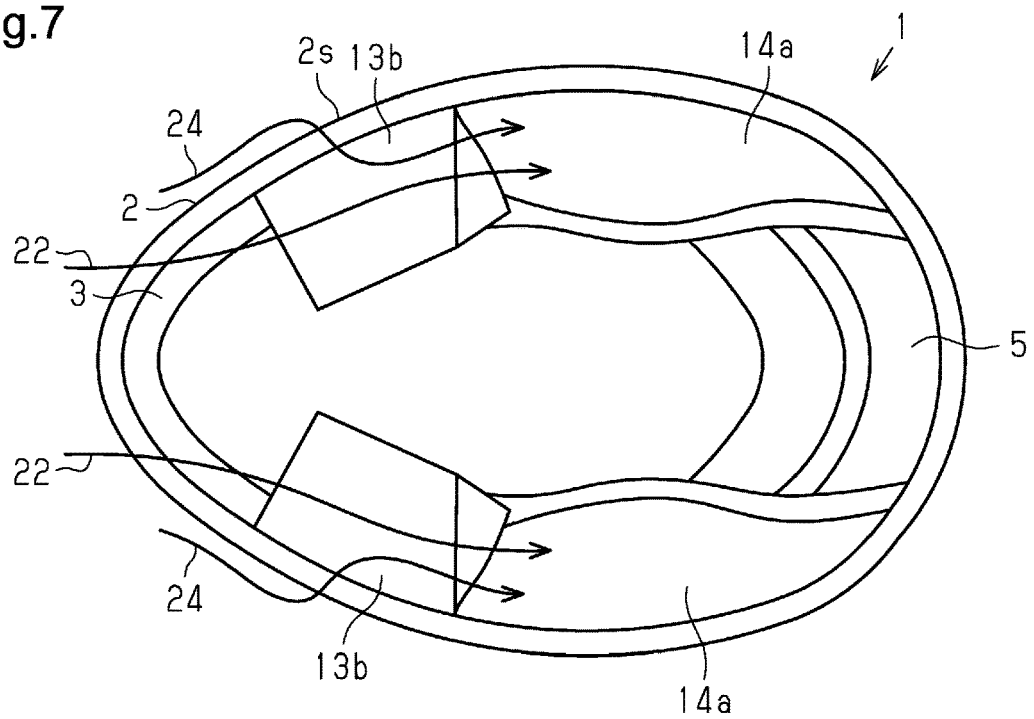
FIG. 7 is a schematic bottom view of the helmet illustrated in FIG. 1 and shows the flow of air when a motorcycle or the like is traveling.

As shown in FIG. 7, the airflow 22 passes below the first outer surface 13*b* and the second outer surface 14*a* and flows rearward from the helmet 1. The first outer surface 13*b* of the cheek pad 10 projecting from the lower end of the helmet body 2 elongates the path of the passing airflow 22 thereby increasing the flow speed. Negative pressure applied to the first outer surface 13*b* and the second outer surface 14*a* generates the downforce 26 pulling the helmet 1 downward. In other words, the first outer surface 13*b* and the second outer surface 14*a* are negative pressure generating surfaces configured to generate the downforce 26 with the negative pressure of the airflow 22.

The airflow 24 from the external surface 2*s* is guided downward from the helmet body 2 along the first outer surface 13*b* and merged with the airflow 22. In this case, the first outer surface 13*b* of the cheek pad 10 projecting from the lower end of the helmet body 2 increases the negative pressure applied to the first outer surface 13*b* and the second outer surface 14*a*. This increases the downforce 26 acting on the helmet 1.

Further, the first outer surface 13*b* is configured to project so that the lower end of the first outer surface 13*b* projects downward from the lower end of the second outer surface 14*a* and toward the middle of the wearing opening 6. This enlarges the area of the first outer surface 13*b*, which serves as the negative pressure generating surface, and further increases the downforce 26 acting on the helmet 1.

The first outer surface 13*b* has a gradient so as to be continuous with the curve of the external surface 2*s*. This ensures that the airflow 24 will be guided downward from the helmet 1 without being separated from the helmet 1. This further increases the downforce 26 acting on the helmet 1.

The paths of the airflows 22, 24 under the second outer surface 14*a* are narrowed by the shoulder. This increases the flow speed of the airflows 22, 24 and further increases the downforce 26 acting on the helmet 1. When the rear end of the first outer surface 13*b* is located rearward from the neck of the wearer, the first outer surface 13*b* located downward from the second outer surface 14*a* will result in the paths of the airflows 22, 24 being excessively narrowed by the first outer surface 13*b* and the shoulder of the wearer. This will hinder the airflows 22, 24 directed toward the rear of the helmet 1 and increase the drag 27. Thus, the rear end of the first outer surface 13*b* is preferably located frontward from the neck of the wearer in order to limit the drag 27. For example, when the location of the right-left maximum width D3 of the helmet body 2 substantially corresponds to the middle of the neck of the wearer in the front-rear direction of the wearer, the rear end of the first outer surface 13*b* is preferably located frontward from the location of the right-left maximum width D3 of the helmet body 2.

The helmet 1 has the following advantages.

(1) The first outer surface 13*b* is located downward from the lower edge of the helmet body 2. Thus, the first outer surface 13*b* guides the airflow 24 downward from the helmet 1. In this case, the airflow 24 generates the downforce 26 acting on the first outer surface 13*b*. The first outer surface 13*b* is located downward from the second outer surface 14*a*. Thus, the airflow 24 guided downward from the helmet 1 by the first outer surface 13*b* generates the downforce 26 that also acts on the second outer surface 14*a*. As a result, the lift acting on the helmet 1 is reduced by the downforce 26 that acts on the first outer surface 13*b* and the second outer surface 14*a*.

(2) The first bottom portion 13 and the second bottom portion 14 forming the wearing opening 6 are resilient so as to enlarge the wearing opening 6 and reduce the wearing opening 6 in size when the force enlarging the wearing opening 6 is removed. This allows the helmet 1 to be easily worn while restoring shapes of the deformed negative pressure generating surfaces after the helmet 1 is worn. Thus, the lift 25 acting on the helmet 1 is reduced and the helmet 1 is easily worn.

(3) The lower end of the first outer surface 13*b* projects downward from the lower end of the second outer surface 14*a* and toward the middle of the wearing opening 6 so that an increase in the area of the first outer surface 13*b*, which is the negative pressure generating surface, further increases the downforce 26 acting on the helmet 1. This further reduces the lift 25 acting on the helmet.

(4) The first outer surface 13*b* has a gradient so as to be continuous with the curve of the external surface 2*s*. This ensures that the airflow 24 will be guided downward from the helmet 1 to further increase the downforce 26 acting on the helmet 1. This further reduces the lift 25 acting on the helmet.

(5) The rear end of the first outer surface 13*b* is located frontward from the location of the right-left maximum width D3 of the helmet body 2. This limits the drag 27 resulting from an increase in the length of the first outer surface 13*b* along the side surface of the helmet body 2.

(6) The rear end of the first outer surface 13*b* is located frontward from the neck of the wearer. This limits the drag 27 resulting from the paths of the airflows 22, 24 excessively narrowed by the first outer surface 13*b* and the shoulder of the wearer.

The above-described embodiment may be modified as follows.

Figure 8:
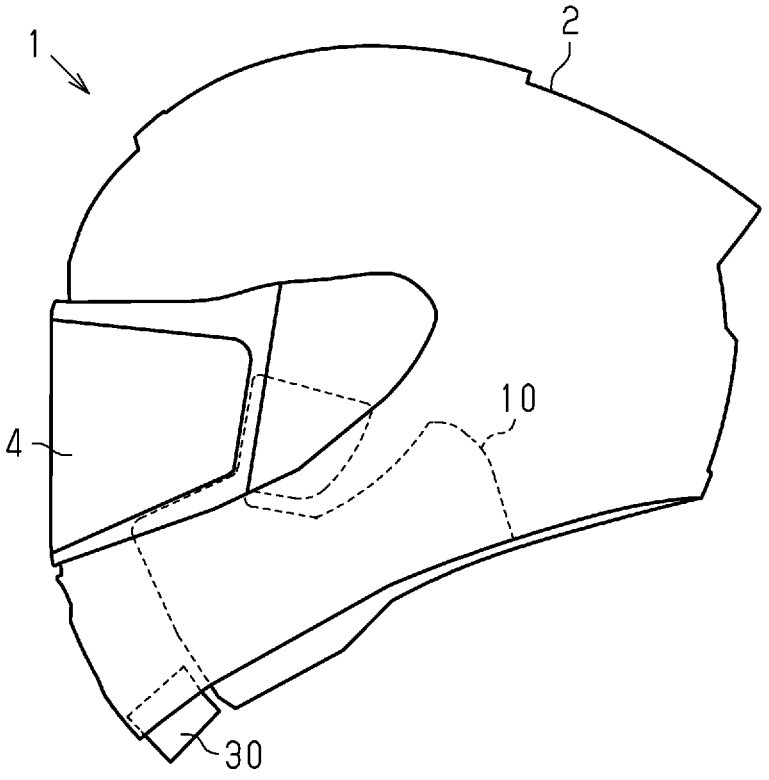
FIG. 8 is a side view showing a modified example of a helmet that includes a chin spoiler.

As shown in FIG. 8, the helmet 1 may include a chin spoiler 30 to further reduce lift. Specifically, the helmet 1 includes the chin spoiler 30 at the front lower edge of the helmet body 2. The chin spoiler 30 extends downward from the lower edge of the helmet body 2 and includes a sloped surface that has a gradient so as to be continuous with the curve of the external surface 2*s*. The upper edge of the chin spoiler 30 is inserted between the helmet body 2 and the liner 3 when the chin spoiler 30 is fixed to the helmet 1. The chin spoiler 30 has functionality for guiding the air received at the front of the helmet 1 downward from the helmet body 2. This increases the airflow 22 passing below the helmet 1 and increases the negative pressure applied to the first outer surface 13*b* and the second outer surface 14*a*, which are the negative pressure generating surfaces. Thus, although the number of components will be increased, the chin spoiler 30 further reduces the lift 25 acting on the helmet 1.

In the example, the rear end of the first outer surface 13*b* is located frontward from the location of the right-left maximum width D3 of the helmet body 2. Instead, the rear end of the first outer surface 13*b* may be located rearward from the location of the right-left maximum width D3 of the helmet body 2. Further, the location of the rear end of the first outer surface 13*b* may be the same as the location of the right-left maximum width D3 of the helmet body 2. In this case, the lift 25 will still be reduced, although the drag 27 will increase.

In the example, the first outer surface 13*b* is a sloped surface having a gradient so as to be continuous with the curve of the external surface 2*s*. Instead, the first outer surface 13*b* may be a curve that has the same curvature as the curvature of the curve of the external surface 2*s*. This guides the airflow 24 downward from the helmet 1 along the first outer surface 13*b*.

In the example, the lower end of the first outer surface 13*b* extends downward from the lower end of the second outer surface 14*a* and toward the middle of the wearing opening 6. Instead, for example, the lower end of the second outer surface 14*a* may extend downward from the lower end of the first outer surface 13*b* and toward the middle of the wearing opening 6. In this case, although the negative pressure generating surface becomes small, the wearing opening 6 will be enlarged so that the helmet 1 can be easily worn.

The helmet 1 may include a chin cover that covers the chin of the wearer. The chin cover will cover the front portion of the wearing opening 6. This prevents airflow from entering the helmet body 2 when the motorcycle or the like is traveling.

In the example, the helmet 1 is a full-face helmet. Alternatively, the helmet 1 may be a flip-up helmet with a chin guard that can be raised, an open face helmet, a helmet with a removable chin guard, or a convertible helmet with a chin guard that is pivoted and fixed to the back of the helmet.

The invention claimed is:

1. A helmet comprising:

a helmet body; and right and left cheek pads arranged inside the helmet body, as viewed from a wearer of the helmet, wherein the cheek pads each include:

a first bottom portion including a first outer surface located downward from a lower edge of the helmet body; and a second bottom portion including a second outer surface located rearward from the first bottom portion, wherein the first outer surface and the second outer surface form a wearing opening of the helmet and are negative pressure generating surfaces configured to generate a downforce acting on the helmet by having the first outer surface located downward from the second outer surface, and the first bottom portion and the second bottom portion are resilient so as to enlarge the wearing opening when receiving force for enlarging the wearing opening and reduce the wearing opening in size when the force is removed, wherein a lower end of the first outer surface projects from the lower edge of the helmet body more greatly than a lower end of the second outer surface;

wherein the first bottom portion and the second bottom portion are separated by an inclined portion that has an inclined surface angled relative to each of the first outer surface and the second outer surface.

2. The helmet according to claim 1, wherein the first outer surface is configured to project further from the lower end of the second outer surface so that the lower end of the first outer surface projects downward from the lower edge of the helmet body and toward a middle of the wearing opening.

3. The helmet according to claim 1, wherein the first outer surface is configured to have a gradient so as to be continuous with a curve of an external surface of the helmet body.

4. The helmet according to claim 1, wherein the first outer surface includes a rear end located frontward from where the helmet body has a right-left maximum width.

5. The helmet according to claim 1, further comprising:

a chin spoiler attached to a front portion of the lower edge of the helmet body.

* * * * *